US010299583B2

(12) United States Patent
Allen

(10) Patent No.: US 10,299,583 B2
(45) Date of Patent: May 28, 2019

(54) LOCKER SEAT ASSEMBLY

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 0 days.

(21) Appl. No.: 16/140,788

(22) Filed: Sep. 25, 2018

(65) Prior Publication Data

US 2019/0021493 A1 Jan. 24, 2019

Related U.S. Application Data

(63) Continuation of application No. 15/603,875, filed on May 24, 2017, now Pat. No. 10,080,433.

(51) Int. Cl.

| | |
|---|---|
| ***A47B 83/00*** | (2006.01) |
| ***A47C 7/24*** | (2006.01) |
| ***A47C 7/40*** | (2006.01) |
| ***A47C 1/00*** | (2006.01) |
| ***A47C 15/00*** | (2006.01) |

(52) U.S. Cl.

CPC ..... *A47B 83/00* (2013.01); *A47C 1/00* (2013.01); *A47C 7/24* (2013.01); *A47C 7/405* (2013.01); *A47C 7/407* (2013.01); *A47C 15/004* (2013.01)

(58) Field of Classification Search

CPC ..... A47B 83/00; A47B 96/00; A47B 85/00; A47B 85/08; A47B 2220/01; A47C 1/00; A47C 7/24; A47C 7/405; A47C 7/407; A47C 17/58

USPC ..... 297/188.04

See application file for complete search history.

(56) References Cited

U.S. PATENT DOCUMENTS

| | | | | |
|---|---|---|---|---|
| 3,475,769 | A | 11/1969 | Fasanella | |
| 4,596,420 | A * | 6/1986 | Vaidya | B60N 2/3084 297/233 |
| D293,403 | S * | 12/1987 | Umanoff | D6/555 |
| D372,603 | S | 8/1996 | Lodispoto | |
| 6,088,849 | A * | 7/2000 | Lieber | A47B 85/08 312/315 |
| 6,948,788 | B1 * | 9/2005 | Tai | A47B 88/956 312/204 |
| D606,181 | S * | 12/2009 | Bock | D23/303 |
| 2003/0222174 | A1 * | 12/2003 | Saint-Jalmes | B60R 7/043 244/118.1 |
| 2006/0080993 | A1 * | 4/2006 | Mullen | B67D 3/0009 62/390 |
| 2011/0025181 | A1 * | 2/2011 | Vinke | A47B 57/20 312/257.1 |

(Continued)

OTHER PUBLICATIONS

Office Action dated Mar. 27, 2018 from corresponding U.S. Appl. No. 15/603,875.

(Continued)

*Primary Examiner* — Mark R Wendell

(74) *Attorney, Agent, or Firm* — James E. Walton

(57) ABSTRACT

An improved locker seat includes a pair of spaced-apart upstanding sidewalls having a pair of front edges. A generally horizontal seat extends between and at least partially forward of the front edges of the sidewalls. A lower seatback is connected at a lower extent by a hinge between the sidewalls and extending above the seat, the lower seatback is movable about the hinge between an open position and a closed position. An upper seatback is connected at an upper extent by a hinge between the sidewalls and above the lower seatback, the upper seatback being movable about the hinge between an open and a closed position.

14 Claims, 4 Drawing Sheets

(56) References Cited

U.S. PATENT DOCUMENTS

| | | | | |
|---|---|---|---|---|
| 2014/0327350 | A1* | 11/2014 | Tassin | A47B 46/00 312/249.7 |
| 2016/0258108 | A1* | 9/2016 | Jindra | D06F 60/00 |

OTHER PUBLICATIONS

Amendment dated May 30, 2018 from corresponding U.S. Appl. No. 15/603,875.
Final Office Action dated Jun. 19, 2018 from corresponding U.S. Appl. No. 15/603,875.
Amendment After Final dated Jul. 24, 2018 from corresponding U.S. Appl. No. 15/603,875.
Notice of Allowance dated Aug. 3, 2018 from corresponding U.S. Appl. No. 15/603,875.

* cited by examiner

LOCKER SEAT ASSEMBLY

This application is a continuation of U.S. patent application Ser. No. 15/603,875, filed 24 May 2017, titled "Locker Seat Assembly," which is incorporated herein for all purposes.

BACKGROUND

1. Field of the Invention

The present invention relates generally to improvements in lockers or storage cabinets used in athletic or sporting facilities, and more specifically to seating incorporated into such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figures 1, 2, 3:
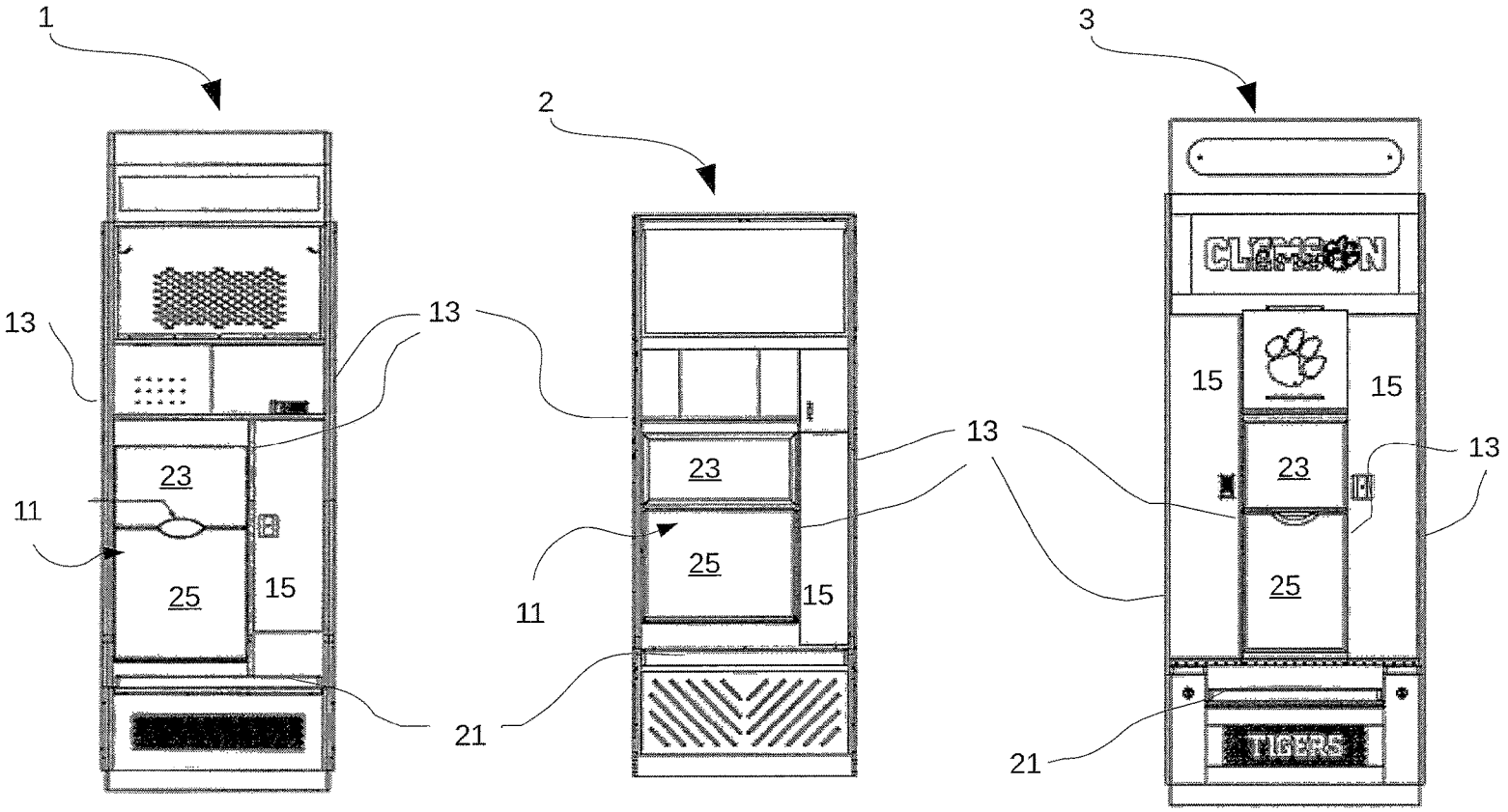
FIGS. 1 through 3 are elevation views of lockers incorporating the seat assembly according to the present application.
Figure 5:
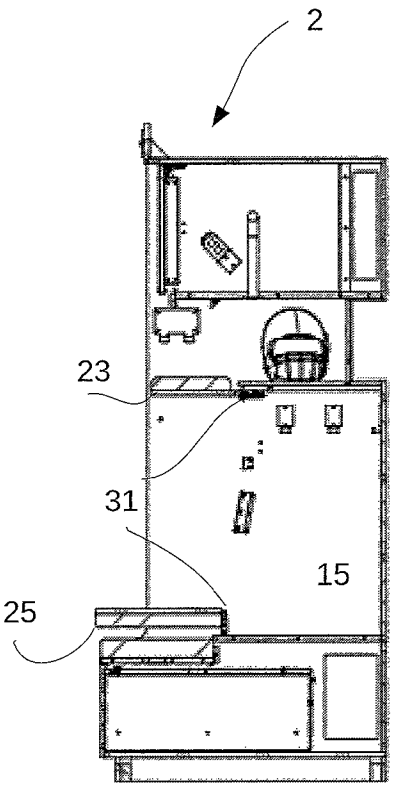
FIGS. 4 through 6 are longitudinal, side section views of each of the lockers of FIGS. 1 through 3.
Figure 6:
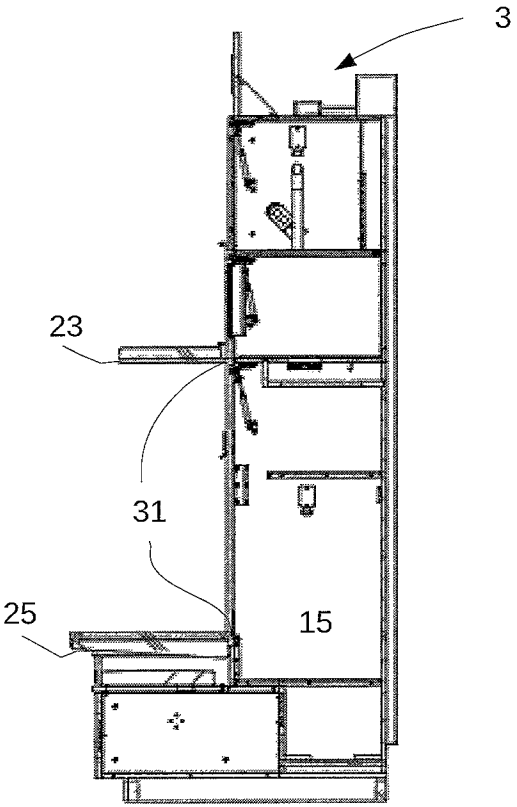
Figure 4:
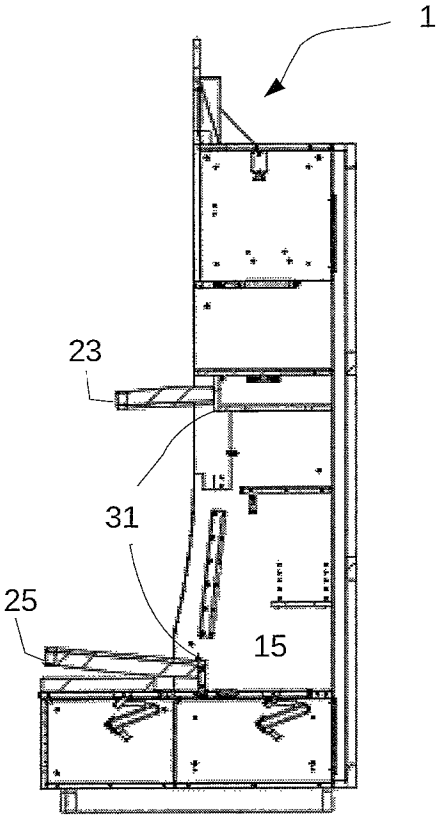

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker seat assembly are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1 through 3 in the drawings, three configurations of lockers 1, 2, 3, each incorporating a locker seat 11 according to the present application are illustrated. As can be seen, each locker 1, 2, 3 comprises a pair of upstanding sidewalls 13 that generally define the extent of the locker. Each locker may be installed adjacent to another, similar or identical locker, with its rear against a wall, and its front facing the interior of the locker room.

Between the sidewalls 13 of each locker 1, 2, 3, a plurality of compartments 15 are defined by shelves or other horizontally extending surfaces or platforms (only one compartment is indicated in each locker for clarity and simplicity). Multiple additional sidewalls may be placed between the "main" or exterior sidewalls 13 to define compartments and the like. As used herein, "sidewall" or "sidewalls" may refer to either "main" sidewalls 13 or other sidewalls arranged between the "main" sidewalls. Each compartment 15 may be sized and otherwise configured for storage of clothing or sporting equipment or other items 15 and may include a door, which may be lockable.

Each of the lockers 1, 2, 3 also incorporates a seat assembly 11 according to an embodiment of the present application. Each seat 11 generally comprises a horizontal portion or bench 21 and the seatback assembly 23, 25 according to the present application. Bench 21 and seatback 23, 25 may be disposed and extend between main sidewalls 13 or other sidewalls defined between the main sidewalls 13. Bench 21 may extend at least partially forward of the front edges of sidewalls 13 and may be bordered by armrests or other structures raised above the sides of bench 21 (see FIG. 3, for example).

As is depicted, seatback 23, 25 extends above and to the rear of horizontal bench 21 and is generally vertical, including slightly inclined to the rear, to support the back of the person sitting on bench 21 (see FIGS. 3 through 6). Each seatback assembly comprises a lower portion 23 and an upper portion 25. Upper 25 and lower 23 portions are connected to sidewalls 13 of the locker by hinges at their upper and lower extents respectively. Upper 25 and lower 23 portions are thus movable, independently of one another, about their respective hinges, between open and closed positions (the closed position is shown in FIGS. 1 through 3).

As shown in FIGS. 3 through 6, seatback portions 23, 25 may be generally aligned with the front edges of the sidewalls between which they are disposed, or may project forward or be recessed. seatback portions 23, 25 preferably are padded and upholstered with an appropriate fabric, such as vinyl or leather or a textile material.

Recesses may be formed in the upper and lower edges of lower 23 and upper 25 seatback portions that cooperate to form an aperture to facilitate opening the seatback. Recesses may be of varying configuration (as shown in FIGS. 1 through 3), curved or square/rectilinear, and may be provided in only one of upper 25 and lower 23 seatback portions, or not at all.

FIGS. 3 through 6 are section views of lockers 1, 2, 3 illustrating seatback in an open position, with upper 23 and lower 25 seatback portions rotated upwardly and downwardly, respectively, about hinges 31, which are mounted between sidewalls 13 on cross members extending between them. Further compartments or storage spaces 15 behind and below seatbacks are illustrated.

Figure 8:
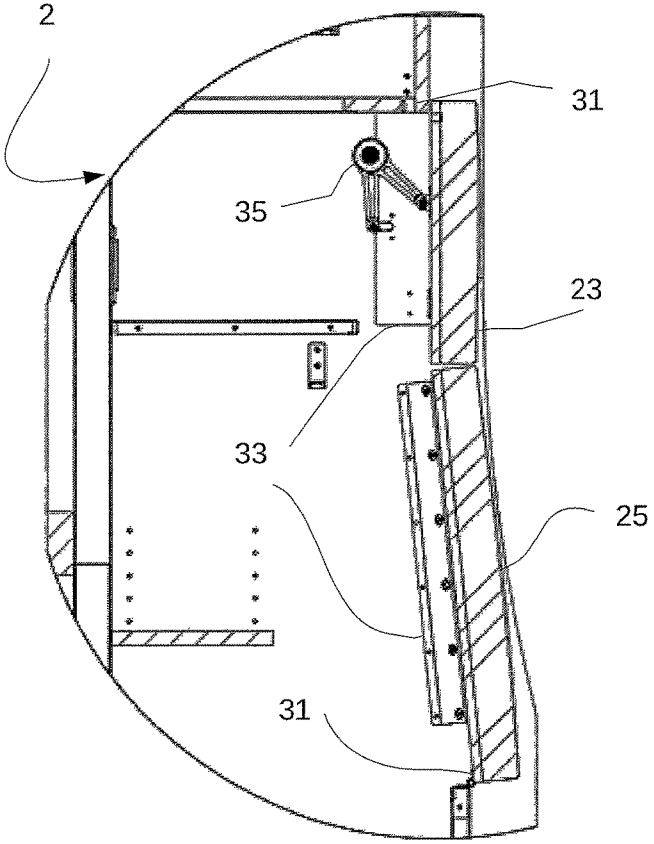
FIGS. 7 through 9 are enlarged, fragmentary section views of a portion of each of the lockers of FIGS. 1 through 6.
Figure 7:
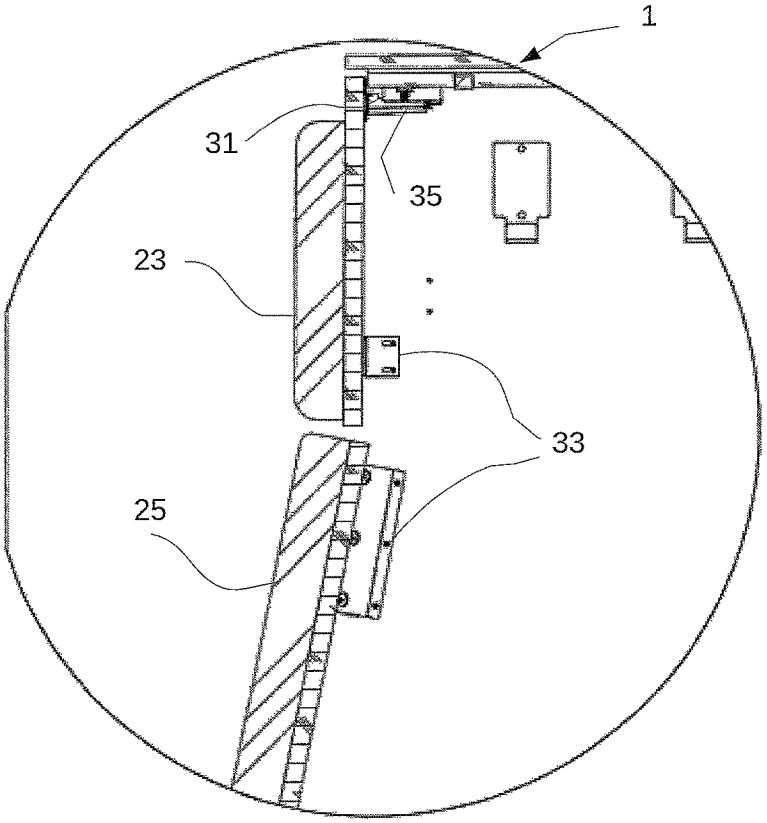
Figure 9:
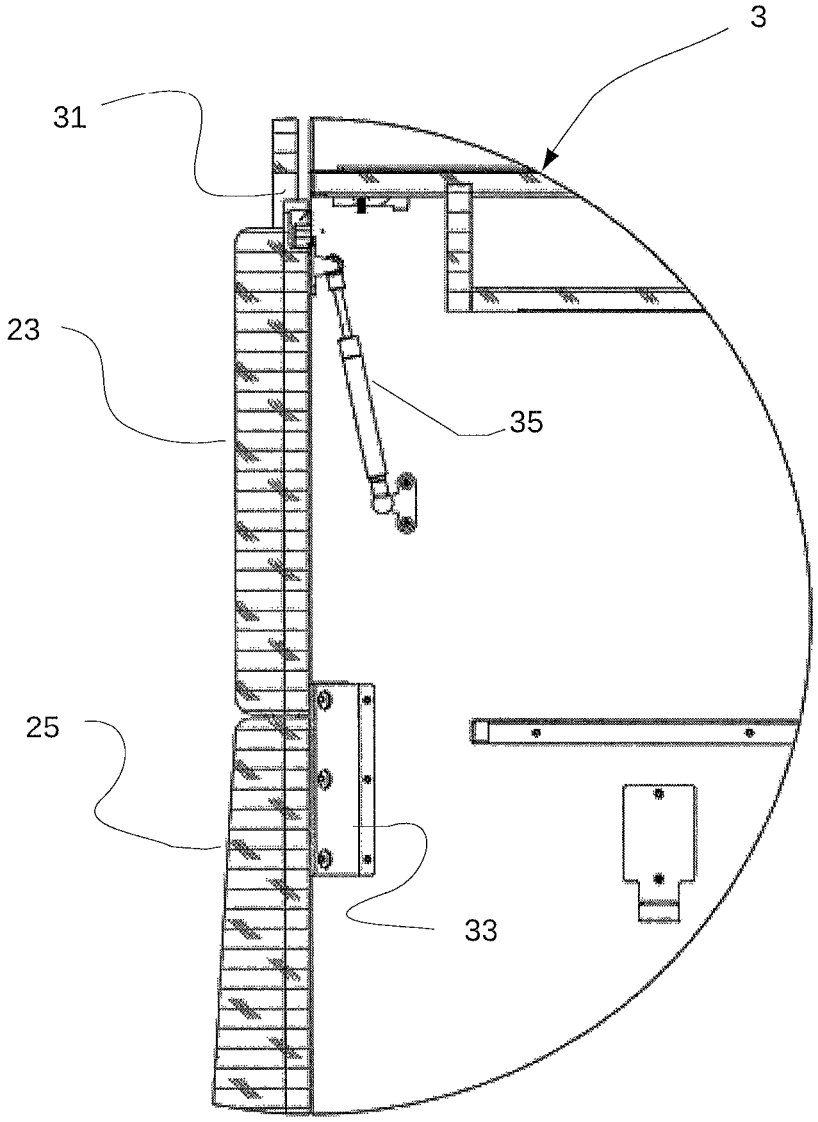

FIGS. 7 through 9 are enlarged section views of portions of lockers 1, 2, 3. As previously described, each upper 23 and lower 25 seatback portion is secured for rotation between sidewalls 13 by a hinge 31. A stop member 33 is secured to each sidewall to stop rotation of upper 23 and lower 25 seatbacks in the closed position. Each stop member is formed of "angle iron" or "L-channel" material with one "leg" secured to sidewall 13 of the locker. It is oriented to abut the rear of each seatback portion 23, 25 to securely prevent it from further rotation in the closed position. In the style of locker 3 (shown in FIG. 9), in which seatback portions 23, 25 are in a common plane, only a single (one for each sidewall) stop member 33 is needed. In the styles of lockers 1 and 2, two stop members (on each sidewall) are needed because the upper and lower portions 23, 25 are in intersecting planes. A hold-open or support strut 35 is associated with upper seatback portions 23 to maintain them in the open position.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker seat, comprising:
a seat bench; and
a seatback member comprising:
a lower seatback having an upper edge and being connected to and movable about a hinge between an open position and a closed position; and
an upper seatback having a lower edge and being connected to and movable about a hinge between an open position and a closed position;
wherein the lower edge of the upper seatback and the upper edge of the lower seatback are adjacent to each other when the upper seatback and the lower seatback are in the closed positions; and
wherein the upper seatback and lower seatback, when in the closed positions, are coplanar with each other.

2. The locker seat according to claim 1, wherein the upper seatback and lower seatback are each in a generally vertical orientation when the upper seatback and lower seatback are in the closed positions.

3. The locker seat according to claim 1, wherein the upper seatback and lower seatback are each in a generally inclined orientation when the upper seatback and lower seatback are in the closed positions.

4. The locker seat of claim 1, further comprising:
at least one stop support strut, connected to the upper seatback, that holds the upper seatback in the open position when a user places the upper seatback in the open position.

5. The locker seat according to claim 1, further comprising;
a recess formed in or adjacent the lower edge of the upper seatback to create a handle for moving the upper seatback between the closed and open positions.

6. The locker seat according to claim 1, further comprising;
a recess formed in or adjacent the upper edge of the lower seatback to create a handle for moving the lower seatback between the closed and open positions.

7. The locker seat according to claim 1, further comprising;
a recess formed in and between the upper edge of the lower seatback and the lower edge of the upper seatback to create handles for moving the upper and lower seatbacks individually between the closed positions and open positions.

8. A locker seat, comprising:
a seat bench; and
a seatback member comprising:
a lower seatback having an upper edge and being connected to and movable about a hinge between an open position and a closed position; and
an upper seatback having a lower edge and being connected to and movable about a hinge between an open position and a closed position;
wherein the lower edge of the upper seatback and the upper edge of the lower seatback are adjacent to each other when the upper seatback and the lower seatback are in the closed positions; and
wherein the upper seatback and lower seatback, when in the closed positions, are arranged along intersecting planes.

9. The locker seat according to claim 8, wherein the upper seatback is in a generally vertical orientation when the upper seatback is in the closed position.

10. The locker seat according to claim 8, wherein the upper seatback is in a generally inclined orientation when the upper seatback is in the closed position.

11. The locker seat of claim 8, further comprising:
at least one stop member located to stop each of the upper and lower seatbacks in the closed position.

12. The locker seat according to claim 8, further comprising;
an aperture formed in or adjacent the lower edge of the upper seatback for opening the upper seatback.

13. The locker seat according to claim 8, further comprising;
an aperture formed in or adjacent the upper edge of the lower seatback for opening the lower seatback.

14. The locker seat according to claim 8, further comprising;
an aperture formed in and between the upper edge of the lower seatback and the lower edge of the upper seatback for individually opening the upper seatback and lower seatback.

* * * * *